United States Patent [19]

John

[11] Patent Number: 4,852,530

[45] Date of Patent: Aug. 1, 1989

[54] AIR POLLUTION CONTROL ELECTROCATALYTIC CONVERTER

[76] Inventor: Manolis John, P.O. Box 380, New York, N.Y. 10028

[21] Appl. No.: 298,579

[22] Filed: Jan. 18, 1989

Related U.S. Application Data

[63] Continuation-in-part of Ser. No. 128,906, Dec. 4, 1987, Pat. No. 4,762,101.

[51] Int. Cl.[4] ..... F02P 19/02

[52] U.S. Cl. ..... 123/145 A; 219/270

[58] Field of Search ..... 123/145 A, 145 R; 219/260, 270, 505, 543

[56] References Cited

U.S. PATENT DOCUMENTS

| | | | |
|---|---|---|---|
| 2,127,983 | 8/1938 | Nowosiolski | 123/145 A |
| 3,458,766 | 7/1969 | Little | 219/270 |
| 3,911,326 | 10/1975 | Ohlsson | 123/145 A |
| 4,058,105 | 5/1978 | Bhat et al. | 123/145 A |
| 4,412,126 | 10/1983 | Brocknall | 219/270 |
| 4,620,512 | 11/1986 | Brooks et al. | 123/145 A |
| 4,650,963 | 3/1987 | Yokoi | 123/145 A |
| 4,725,711 | 2/1988 | Minagishi et al. | 123/145 A |

*Primary Examiner*—Raymond A. Nelli

[57] ABSTRACT

An electrocatalytic converter according to the present invention includes a base portion having a fixing portion formed on an outer wall thereof and a terminal insulatedly provided therein and connected to an electrical source; a plurality of outwardly projected heating fins covered with a thin coating of platinum, palladium and rhodium formed on the outer wall of the heating surface; a heating means, integrally connected to the base portion, having a heating surface formed on a wall surface thereof and composed of a catalyst comprising a transition material and a heating means having a resistive exothermic element connected to the element being provided adjacent.

4 Claims, 1 Drawing Sheet

AIR POLLUTION CONTROL ELECTROCATALYTIC CONVERTER

REFERENCE TO RELATED APPLICATION

The present patent application is a continuation-in-part of patent application Ser. No. 128,906, filed Dec. 4, 1987 and now U.S. Pat. No. 4,762,101.

BACKGROUND OF THE INVENTION

The present invention relates to a new and improved air pollution control device, and more particularly to an electrocatalytic converter for controlling the temperature and the chemical composition of the exhausted unburned gases of combustion engines and particularly low temperature air pollution stemming out from other diverse sources associated with industrial processes, energy production, residential woodburning units, Kerosene heaters, automobile exhaust pipes, etc. Different air pollution control approaches are being used but air pollution problems remain unsolved. The conventional catalytic converters employed in automobiles are inefficient and useless for low temperature air pollutants stemming out from many sources. Innovation is needed to develop new ways to deal with air pollution problems. The electrocatalytic converter protrudes in the pollutants' exhaust line. The electrocatalytic converter is comprising a tubular heating rod having a plurality of heating fins. The heating fins are metallic or ceramic projections rigid, flat, or curved surfaces radially mounted along the tubular heating rod. Both the heating rod and heating fins are covered with a tiny coating of platinum, palladium and rhodium and they are acting as thermocatalysts.

When low temperature air pollutants are forced to flow through the electrocatalytic converter they contact the heating rod and heating fins which cause a rapid increase in the exhaust temperature. This in turn causes the hydrocarbons and carbon monoxide to change into water vapor and carbon dioxide, and reduce oxides of nitrogen. Both oxidation and reduction take place on the surface of the heating rod and the heating fins, which as catalysts do not participate in the reaction.

SUMMARY OF THE INVENTION

It is an object of the present invention to provide an air pollution control device and more particularly to a new electrocatalytic converter connected to an electrical source and comprising a heating rod and a plurality of projected heating fins mounted on the outer wall of the heating rod, both heating fins and heating rod are covered with a thin coating of platinum, palladium and rhodium. It is another object of the present invention to provide a new electrocatalytic converter which increases the exhaust temperature and also causes a chemical reaction that converts certain air pollutants in the exhaust gases into harmless substances.

It is a further object of the present invention to provide an electrocatalytic converter installed in the pollutants exhaust line to increase the temperature, control air pollution and significantly lower emission levels of hydrocarbons (HC), carbon monoxide (CO), oxides of nitrogen (NO) and nitroaromatics.

Still it is another object of the present invention to provide a new and improved air pollution control device for low temperature emissions. The electrocatalytic converter is a thermocatalyst type with a rod heater having a plurality of aerodynamic outwardly projected heating fins mounted on the outer wall of the heating rod, designed to increase the heating surface and dissipate heat to the unburn gases and to the low temperature emissions in the exhaust line. The heating rod and the heating fins are acting as catalysts, they are covered with a tiny coating of platinum, palladium and rhodium.

Still it is a further object of the present invention to provide a new and improved air pollution control device comprising an electrocatalytic converter with a thermocatalyst which will eliminate use of platinum without significantly increasing the use of related metals, and in turn will reduce the nation's dependence on platinum imports.

DESCRIPTION OF THE PREFERRED EMBODIMENTS

The present invention will be described in detail with reference to the preferred embodiments in conjunction with the accompanying drawings.

Figure 1:
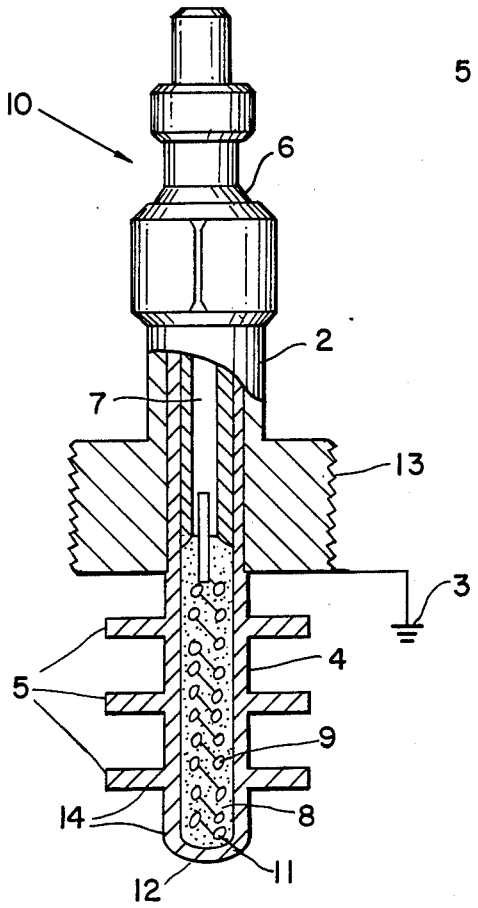
FIG. 1 is a partially longitudinal sectional view of an electrocatalytic converter in accordance with the present invention.
Figure 2:
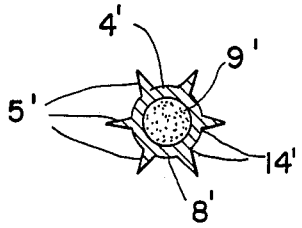
FIG. 2 is a sectional view of the electrocatalytic converter showing the arrangement of the heating fins covered with a thin coating of platinum, palladium and rhodium.

Referring now in more detail to the Drawing FIG. 1 an electrocatalytic converter indicated generally at 10 comprises a shell 2 threadbly engagable with the emissions exhaust line (not shown). The shell 2 is electrically grounded through the exhaust line as schematically indicated at 3. The electrocatalytic converter also comprises an electrically conducting, tabular 4. The tubular heating 4 comprises a plurality of outwardly extending heating fins 5. The heating 5 are thin metallic or ceramic projections usually relatively rigid, flat or curved surfaces radially mounted along the tubular heating rod 4. The heating fins 5 are designed to radiate and dissipate heat from the heating rod 4 to the exhaust gases in the exhaust line. FIG. 2 shows the arrangement of the heating fins 5' covered with a thin coating of platinum, palladium and rhodium. The electrocatalytic converter 10 comprises an insular 6 while holding a positive terminal 7. In the catalyst 8, there is coaxially arranged a resistive exothermic element 9 having a coil shape, which is connected highly conductively with the positive terminal 7. The resistive exothermic element 9 and the metal tube 4 are properly insulated from each other by the insulating function of the catalyst 8. The opposite end portion 11 of the resistive exothermal 7 of the same is grounded to the tubular heat rod 4 at the bottom portion 12 thereof.

The electrocatalytic converter 10 has its tubular heating rod 4, and heating fins 5 covered with a thin coating of platinum (Pt), palladium (Pd) and rhodium (Rd) as indicated at 14 and 14'. The heating rod 4 and the heating fins 5 constituting a thermocatalyst which will be effective for all temperatures of the air pollutants stemming out from diverse sources.

In operation: When the electrocatalytic converter 10 is installed in the pollutants' exhaust line, the resistive exothermic element 9 of the electrocatalytic converter 10 may be energized. As a result, the resistive exothermic element 9 liberates heat to heat the heating rod 4 and the heating fins 5.

The heating rod 4 and the heating fins 5 create and dissipate enough heat to increase the temperature of the exhaust gases.

The heating rod 4 and the heating fins 5 are covered with a thin coating of platinum, palladium and rhodium as indicated at 14 and 14'.

Thus the rod 4 and fins 5 are the thermocatalysts of the electrocatalytic converter 10. When the air pollutants are forced to flow through the electrocatalytic converter 10 they contact the heating rod 4 and the heating fins 5 which cause a rapid increase in the exhaust temperature. This in turn causes the hydrocarbons (HC) and carbon monoxide (CO) to change into water ($H_2O$) vapor and carbon dioxide ($CO_2$), and reduce oxides of nitrogen ($NO_x$).

Moreover, the present invention can adopt modes of various modifications and deformations in addition to any suitable selected combination of the aforementioned respective embodiments if it is within the scope of the claim.

What is claimed is:

1. An electrocatalytic converter comprising:

(i) a base portion having a fixing portion formed on an outer wall thereof and a terminal insulatedly provided therein and connected to an electrical source;

(ii) a heater means integrally connected to the said base portion, having heating surface and heating fins formed on a wall surface thereof and composed of a catalyst a transition metal;

(iii) a heating means comprising a resistive exothermic element connected to the terminal of said base portion, the resistive exothermic element being provided adjacent to the heating surface within the heating means;

(iv) a plurality of heating means fins outwardly extending projections radially mounted on the outer wall of the base portion and (v) said base portion and heating fins are covered with a thin coating of platinum (Pt), palladium (Pd) and rhodium (Rd).

2. An electrocatalytic converter according to claim 1, wherein said heating fins are covered with a thin coating of platinum (Pt).

3. An electrocatalytic converter according to claim 1, wherein said heating fins are covered with a thin coating of palladium (Pd).

4. An electrocatalytic converter according to claim 1, wherein said heating fins are covered with a thin coating of rhodium (Rd).

* * * * *